US005936184A

United States Patent [19]

Majerus et al.

[11] Patent Number: 5,936,184

[45] Date of Patent: Aug. 10, 1999

[54] DEVICES AND METHODS FOR CLEARANCE OF MINES OR ORDNANCE

[75] Inventors: Mark E. Majerus, Middletown, Del.; Ronald L. Brown, Danville, Calif.

[73] Assignee: Tracor Aerospace, Inc., Austin, Tex.

[21] Appl. No.: 08/975,235

[22] Filed: Nov. 21, 1997

[51] Int. Cl.[6] ..... B64D 1/04; F42B 1/00; F42B 7/02

[52] U.S. Cl. ..... 89/1.13; 102/306; 102/403

[58] Field of Search ..... 89/1.13, 1.11; 86/50; 102/306, 307, 309, 402, 403

[56] References Cited

U.S. PATENT DOCUMENTS

| | | | |
|---|---|---|---|
| 2,925,038 | 2/1960 | Walker | 89/1.13 |
| 3,109,369 | 11/1963 | Plumley . | |
| 3,117,518 | 1/1964 | Porter et al. . | |
| 3,265,598 | 8/1966 | Rohrman . | |
| 4,046,055 | 9/1977 | McDanolds et al. | 86/1 B |
| 4,493,239 | 1/1985 | Pedersen | 89/1.13 |
| 4,932,831 | 6/1990 | White et al. | 89/1.13 |
| 4,955,939 | 9/1990 | Petrousky et al. | 102/306 |
| 5,136,920 | 8/1992 | Breed et al. | 86/50 |
| 5,140,891 | 8/1992 | Husseiny et al. | 86/50 |
| 5,210,368 | 5/1993 | Heller, Jr. et al. | 86/50 |
| 5,223,661 | 6/1993 | Sabri | 89/1.13 |
| 5,223,666 | 6/1993 | Delaney, Jr. | 102/306 |
| 5,249,500 | 10/1993 | Husseiny et al. | 89/1.11 |

*Primary Examiner*—Charles T. Jordan
*Assistant Examiner*—Theresa M. Wesson
*Attorney, Agent, or Firm*—Arnold White & Durkee

[57] ABSTRACT

Disclosed are devices and methods for the destruction of an explosive device, such as mines and other unexploded ordnance, without the detonation of the explosive device. The devices comprise an explosive charge that penetrates and opens the casing of an explosive device and forces reactive material into the explosive device, thus neutralizing it.

34 Claims, 7 Drawing Sheets

DEVICES AND METHODS FOR CLEARANCE OF MINES OR ORDNANCE

BACKGROUND OF THE INVENTION

1. Field of the Invention

The present invention relates generally to the fields of mine or other ordnance neutralization. More particularly, it concerns devices and methods for the destruction of mines and/or unexploded ordnance without detonation of the explosive fill of the mine or ordnance.

2. Description of Related Art

Explosive devices, such as mines and unexploded ordnance, represent a major danger to equipment and military personnel during military action, and, due to the long-lived potential for explosion, to military and civilian personnel long after the military action is complete. Therefore, there is a need for methods of safely neutralizing such mines and ordnance. Mine neutralization can be accomplished by manually probing, finding, and extracting the mine. This is an expensive and time-consuming operation. In-situ neutralization can be performed by exploding the mine. However, at times it is preferable to neutralize the mine without a high order reaction particularly in areas of sensitive infrastructure, and under conditions where it would not be desirable to spread metallic debris that could further hinder the detection of neighboring mines.

In detonation neutralization procedures, typically, once an unexploded mine or piece of ordnance is discovered, the mine or ordnance is destroyed by detonation of a secondary device, for example, a block of C-4 type explosive compound placed and detonated on the target explosive device, which in turn causes the detonation of the mine or ordnance. However, while effective in neutralizing the mine or ordnance, detonation can cause a number of problems. The detonation can leave a crater, which has an impact on the terrain and mobility over the terrain. Further, the detonation can spread metallic debris from the mine or ordnance casing that can hamper subsequent detection operations, or scatter small anti-personnel (AP) mines or ordnance. Also, the detonation and fragments can damage surrounding structures, equipment or personnel that can not be moved away from the explosive device (for example, where the explosive device is near a bridge or a building). Additionally, there is a technical challenge in defeating the explosive of some devices, due the non-uniform geometric spacing of the explosive within the device.

One non-explosive method of destroying a mine is a system that uses a chemical agent to induce a hypergolic reaction with the explosive fill of a mine that has been demonstrated by IIT Research Institute (IITRI). This system uses a modified rifle, agent reservoir and a tripod. The tripod is set over a mine and the rifle aimed downward. The agent reservoir is at the end of the rifle. Remotely fired, the bullet passes through the agent reservoir and into the mine. The agent then drips into the mine via gravity. However, this system has a number of drawbacks. First, a minimal amount of the surface area of the explosive fill of the mine is exposed by the bullet hole, decreasing the ability of the chemical agent to reach the target. Second, the small bullet hole decreases the effectiveness of this system in regards to pinpoint detection of the location of the mine and the position of the explosive fill within the mine, as well as asymmetrical distribution of the explosive fill within the mine. Third, the effectiveness of this system against unexploded ordnance other than mines is uncertain.

Thus, an apparatus or device that could destroy an explosive device such as a mine or unexploded ordnance without detonation of the explosive device, that was effective in exposing a large area of the explosive fill to allow flexibility in orientation of the apparatus and detection of the explosive device, and that was effective against explosive devices that do not have an even geometric distribution of explosive would represent a significant advance in the art.

SUMMARY OF THE INVENTION

The present invention overcomes these and other deficiencies in the prior art by providing a neutralization device comprising a charge, such as a linear or cylindrical shaped charge, for penetrating and opening up vent holes in an explosive device, such as a mine or unexploded ordnance. A reactive chemical, stored in a reservoir or compartment in front of the charge, is ejected through a hole formed by or penetrated by the jet and into the explosive device. The forward ejection of reactive chemical is caused by expanding gaseous products from the charge detonation. The charge is designed to achieve the desired penetration and large hole venting without initiating an explosive reaction or detonation of the explosive fill or contents of the explosive device. The chemical agent, or "follow-through chemical" reacts exothermically with the explosive fill, developing sufficient heat to catalyze total degradation of the remaining explosive.

The present devices have the ability to penetrate through more overburden and cut through hardened mine cases and ordnance casings than other approaches. This exposes a larger surface area of the explosive fill, which provides a greater opportunity for the chemical agent to encounter some area of the explosive fill of the device. The present apparatus operate over the area of the device, allowing flexibility in orientation and alignment of the apparatus, and effectiveness against non-symmetrical mine fills. Additionally, the design is such that application of the apparatus is not limited to the nature of the terrain (structure and content), and reasonable ranges of standoff are possible. The apparati can be linked together to provide coverage to a relatively large area, allowing for compensation for detection uncertainty. The apparati are lightweight and inexpensive to produce, and have little value as a terrorist weapon as compared to a bulk explosive charge.

The invention provides an apparatus for neutralizing an explosive device, comprising a first portion, or "explosive device proximal portion," the first or proximal portion comprising a first reservoir, a first chemical agent for neutralizing the explosive device disposed within the first reservoir, and a second portion, or "explosive device distal portion," the second or distal portion operably connected to the first portion, the second portion comprising an explosive assembly. The first portion and the second portion are operably connected such that the explosive assembly is positioned substantially at the top or uppermost point of the apparatus, and the base of the first portion is positioned substantially at the bottom or lowermost point of the apparatus, in relation to the explosive device. In preferred aspects of the invention, the explosive assembly comprises a liner and an explosive charge.

In particular aspects of the invention, the apparatus further comprises a front faceplate or endplate and/or a back faceplate or endplate. In certain aspects, the first portion further comprises a case, and in other aspects, the second portion further comprises a housing. The apparatus may be fabricated by injection or blow molding, or constructed using other conventional techniques well-known to those of skill in the art with the benefit of the instant disclosure.

Two key components influence the geometric volume and weight of the apparatus. The quantity of reactive chemical agent that must be delivered to the exposed explosive fill of the mine strongly influences the size of the first portion. The volume of material is largely controlled by the width and height of the first portion. Increased length or diameter of the apparatus can increase the volume of chemical agent, but not all of that agent may be injected into the explosive device, unless the profile of the apparatus completely falls within the perimeter of the explosive device. The design should include a width to height ratio sufficient to assure that a significant quantity of the agent reaches the explosive device.

For example, the size of a linear apparatus can be between about 1 inch and about 12 inches or so in height, between about 1 inch and about 12 inches or so in width, and between about 1 inch and about 12 inches or so in length. Intermediate values are also contemplated, such as about 2 inches, about 2.5 inches, about 3 inches, about 4 inches, about 5 inches, about 6 inches, about 7 inches, about 8 inches, about 9 inches, about 10 inches or about 11 inches in height, width or length. Particularly preferred dimensions are about 2 inches to about 6 inches in length, and about 2 inches to about 4 inches or so in width and height. An apparatus of about 3.2 inches in height, about 2.5 inches in width and about 2.5 inches in length would accommodate a penetration requirement of 4 inches and efficient injection of a 20 ml volume store of diethylene triamine (DETA). For a cylindrical apparatus, the diameter and height can be between 1 inch and about 12 inches or or so, with intermediate values such as about 2 inches, about 2.5 inches, about 3 inches, about 4 inches, about 5 inches, about 6 inches, about 7 inches, about 8 inches, about 9 inches, about 10 inches or about 11 inches also contemplated.

The second factor that controls the size of the apparatus is the penetration requirement. The penetration requirement is derived from the amount of earth overburden that may be situated above the explosive device, the thickness and material of the mine case, or the thickness and material of the unexploded ordnance (ie. 1000 pound bomb may have a 0.5 steel case). The penetration capability is directly related to the density of the liner and the length of the developed jet: the higher value of each the greater the required penetration capability. The penetration requirements are much less stringent than for an anti-armor shaped charge. The explosive cutting charge is required to penetrate no more than 1 cm of equivalent steel. PROM-1 and M21 should be considered the thickest metal cases that must be opened. The density of the liner can easily be tailored by using different liner materials. It is possible to achieve different penetrations using a nylon liner or an aluminum liner, and a copper liner could also be used to achieve even deeper penetration. The jet length is largely affected by the jet tip velocity, jet mass, and material dynamic ductility. The jet tip velocity and jet mass can be controlled via the quantity of explosive and the liner angle and thickness. Increasing the tip velocity tends to increase the jet length; however, it also increases the jet kinetic energy. There exists a level at which the kinetic energy of the jet can detonate the explosive fill. The jet tip is designed to stay below these critical levels. The jet velocities are restricted to velocities of about 4 km/sec or slower. This coupled with the low densities of the material prevents shock initiation of the explosive during the penetration event.

In particular aspects of the invention, the first portion, second portion, the faceplates or endplates, the housing, the case and/or the reservoir(s) are fabricated from plastic, metal, glass, ceramic or a composite material. Plastics contemplated for use include, but are not limited to, Teflon®, Viton®, polypropylene, polycarbonate, polyethylene, high density polyethylene, polyurethane and nylon. Metals contemplated for use include, but are not limited to, aluminum, titanium, zirconium, copper, tantalum, tungsten, depleted uranium, nickel, molybdenum, beryllium, iron, steel or compacted metal powder. Glasses contemplated for use include, but are not limited to Pyrex® or S2 glass. Ceramics contemplated for use include, but are not limited to, oxides of aluminum (alumina), magnesium and zirconium and silicon carbide. Composite materials contemplated for use include, but are not limited to, glass and carbon filled aliphatic and aromatic nylons, Kevlar®, epoxy and carbon or glass reinforced epoxy. Materials for use in fabrication of the housing or casing must be compatible or inert (i.e., not react with) with the explosive fill during the possible shelf life of the device. In addition, materials for use in fabrication of the reservoir(s) should be compatible with the chemical agent(s) stored therein during the lifetime of the device.

The number and sizes of the reservoirs can vary, depending on the particular explosive device or explosive fill to be neutralized. This "scaleability" allows the scale-up of the design of the instant apparatus, thereby eliminating lengthy redesign. Furthermore, the shape of the reservoir(s) is not critical, but should be configured so as to avoid interdiction with the liner and jet, and allow sufficient distance for jet elongation prior to target impact. The configuration of the compartment should accommodate a sufficient fill of reactive material and effectively couple the gaseous expansion of detonation products to the compartment casing, so as to deform and squirt out the reactive chemical agent fill. Thus, reservoirs that are generally round, square, rectangular, triangular, rhomboid or give find utility in different aspects of the invention.

In another embodiment of the invention, the first reservoir is adapted or scored to rupture or open during use of the apparatus, thereby releasing the first chemical agent. In certain aspects, the first reservoir is formed within or defined by the first portion. In other aspects, the first reservoir is operably attached to the first portion.

The liner should have intrinsic characteristics sufficient to support high jetting velocities and high strain ductility required to meet penetration requirements, while avoiding impact compressions sufficient to initiate explosive events. The liner may be fabricated from a number of different materials, including, but not limited to: plastics such as Teflon®, Viton®, polypropylene, polycarbonate, polyethylene, high density polyethylene, polyurethane, nylon and other straight-chain polymers; metals, including, but not limited to, aluminum, titanium, zirconium, copper, tantalum, tungsten, depleted uranium, nickel, molybdenum, beryllium, iron, steel or compacted metal powder; or glass such as Pyrex®. In certain embodiments of the present invention, the shaped charge liner is composed of incendiary or pyrophoric material(s), or a material that reacts with the follow-through reactive chemical agent and forms an ignition mixture prior to impact into the explosive compartment of the explosive device. Furthermore, some mines, such as the VS1.6, will more than likely develop an explosion type reaction; therefore in some aspects of the invention, a burning reaction that leads to an explosion will be required.

The liner material in combination with the liner angle provides a means for developing wider craters and exposing larger surfaces of explosive to the chemical reactant when compared to a hole from a denser and faster jet. The amount of explosive and the subcalibering of the liner are also designed to provide a sufficient quantity of expanding detonation products to forcibly inject the reactant fill in the forward compartment. Too much explosive could lead to problems with over-heating and atomization of the chemical agent which could decrease its reactive efficiency.

In particular aspects of the invention, the explosive charge is a linear or a cylindrical shaped charge, or a mini-shaped charge cluster array. Materials contemplated for use in the explosive charge include, but are not limited to, any trinitrotoluene (TNT) hexahydro-1,3,5-trinitro-1,3,5-triazine (RDX), octahydro-1,3,5,7-tetranitro-1,3,5,7-tetrazocine (HMX), 2,2-bis[(nitro-x,y)-methyl]-1,3propanediol-dinitrate (PETN), 2,4,6-trinitro-1,3,5-benzene-triamine (TATB), TNAZ, or CL-20 based explosive, ammonium nitrate, nitromethane, a Comp A3 pressed explosive billet or a detasheet. In certain aspects of the invention, binder materials are included. However, the apparatus offers minimal penetration capability to prevent it from being used for nefarious purposes, and the quantity of explosive in the charge is minimized to prevent the scattering of small AP mines during the device operation.

In additional aspects of the present invention, the second portion further comprises a detonator or initiation system. Initiation of the charge can be via a suitable detonator, for example, electric or non-electric detonators (blasting cap), electro-explosive devices (EED), explosive bridgewire (EBW) detonators, exploding foil initiators (EFI), or detonating cord. In certain embodiments, the second portion further comprises a connector for attachment of the detonator. In particular aspects, the connector can be a hole in the housing or case through which the detonator passes. In other aspects a command initiated fuse is used, either alone, with an integral detonator or with a small charge used to trigger a secondary detonator.

After emplacement, the charge can be detonated locally or remotely using various initiation assemblies in conjunction with a detonator. Such initiator/detonator assemblies can include: safety fuse delayed detonators, electrically initiated detonators, or RF (radio frequency) Command Initiated Fuses (CIF). The CIF allows the charge to be remotely armed and detonated. This allows a safe separation distance for equipment and personnel and also allows the simultaneous command initiation of numerous charges for military type assault breaching operations. The simultaneous initiation capability has the additional advantage of eliminating the possibility of fratricide between closely spaced mines during neutralization. Of course, a CIF-based munition can be detonated at any desired time, and there is often no need for simultaneous detonation of multiple munitions.

A number of different chemical agents are contemplated for use in various aspects of the present invention, including, but not limited to, diethylene triamine (DETA), ethylene diamine (EDA), a thermite mixture of iron oxide and aluminum or copper oxide and aluminum, sodium chlorate and iron powder, magnesium and Teflon®, titanium and Viton®, triethyl aluminum, diethyl zinc, a propellant, a hydrocarbon, such as pentane, hexane or octane, a powdered metal, such as powdered magnesium, powdered aluminum or powdered zirconium, gasoline, misch metal or white phosphorus. The addition of binders such as halogenated polymers (e.g., Teflon™ and Viton™) for handling and formability can enhance the effectiveness of the basic reaction for the follow-through applications. These polymeric materials can also be used for the body material, thereby having a dual role of containment and active reactant ingredient. These reactions would be thermally initiated by the detonation products from the shaped charge.

A preferred chemical agent for use in many aspects of the present invention is DETA. The Night Vision and Electronic Sensors Directorate (NVESD) of the U.S. Army has demonstrated that TNT and RDX explosive compositions can be chemically neutralized by the injection of DETA without causing detonation or igniting wood and plastic mine cases. Eighty to ninety percent of all mines contain some quantity of TNT. DETA is effective against TNT, Comp B, Tetrol and RDX fills. There appears to be no critical issues relative to this particular chemical agent with respect to safety and cost.

DETA is a strong nucleophilic reactant (or organic base). It reacts with nitro-benzenes and nitro-toluene-compounds, forming highly colored intermediate charge transfer Meisenheimer-Ubanski (quinoids) complexes which decrease aromatic resonance stability resulting in the replacement of the nitro-groups and ring cleavage. Similarly, DETA reacts with aliphatic nitramines (e.g., RDX) causing heterocylic ring cleavage at the C—N bond and fragmenting the molecule into smaller and more reactive nitramines molecules. DETA is a readily available chemical. It has many uses in the polymer industry and is a detonation sensitizer for nitromethane.

The chemical agent should be pushed or forced into the explosive device at relatively low velocities and temperatures. The explosive detonation products from the linear charge are under several million psi and are several thousand degrees. However, the chemical agent temperature should be kept below the flash or boiling temperature of the chemical agent, and the injection velocities should also be kept fairly slow to prevent dispersion or atomizing the agent.

The chemical agent temperature should be less than about 200° F. to about 250° F., and preferably 150° F. or less as it enters the mine case, and the chemical agent velocity should be less than 400 mph, preferably less than 200 mph, and more preferably on the order of 80 to 100 mph or less. Operating environmental effects also need to be considered. High altitudes and/or high humidity can degrade reaction rates. Most determining operations do not occur below 40° F. but may extend up to 125° F.

The shelf life of the chemical agents contemplated for use will generally be at least about one to about two years, with chemical agents having a longer shelf life, for example up to about 3 years, about 5 years, about 7 years, about 10 years, about 15 years, about 20 years or about 30 years also having utility, and actually being preferred is certain aspects of the invention. Additionally, chemical agents that have a shelf life of less than about one year, on the order of months or in certain instances even days, find utility in particular applications of the invention.

The present invention also provides methods for the identification of alternative chemical reactants and screening out incompatible materials. This is important because while a majority of mines and ordnance comprise TNT, some comprise PETN or ammonium nitrate. However, PETN and ammonium nitrate fills do not respond to DETA. Therefore, a second agent must be identified to neutralize these other explosives. Thus the present invention provides a binary agent system within the standoff base that does not affect one another. Another approach contemplated by the present invention is the identification of an agent that will effectively neutralize all explosives.

The present invention also provides a method for screening for chemical agents effective in neutralization of selected explosive fills, comprising placing a candidate chemical agent into a first reservoir of an apparatus for neutralization of explosive devices, the apparatus comprising a first portion comprising a first reservoir, and a second portion operably connected to the first portion, the second portion comprising an explosive assembly, positioning the apparatus proximal to a mine or ordnance stimulant comprising a selected explosive fill, detonating the explosive assembly, and determining or monitoring the selected explosive candidate chemical agent on the selected explosive fill, wherein the ability of the candidate chemical agent to neutralize the selected explosive agent is indicative of a chemical agent effective in neutralization of selected explosive fills. This technique can also be used to identify combinations of chemical agents effective in neutralization of selected explosive fills, by placing a first and a second candidate chemical agent into the first reservoir, with the agents in separate modules within the first reservoir, separated by a barrier, or by placing the candidate agents into separate reservoirs.

Thus, also contemplated for use are two or more chemical agents that react with each other exothermically, producing sufficient heat to ignite burning reactions in the explosive. Thus, in further embodiments of the present invention, the first reservoir further comprises a second chemical agent for the neutralization of the explosive device. In certain aspects, the first chemical agent is a saturated solution of a nitroaromatic, such as trinitrotoluene, dinitrotoluene or 1,3,5-trinitrobenzene, in solvents such as acetone or methylene chloride, and the second chemical agent is diethylene triamine or ethylene diamine. In preferred aspects, the first reservoir further comprises a barrier adapted to separate the first chemical agent from the second chemical agent prior to use, or comprises individual modules with the first and second chemical agent disposed therein. In aspects including a barrier or modules, the barrier or modules may be adapted to rupture or open during use of the apparatus, thereby allowing the first chemical agent and the second chemical agent to mix and exit the reservoir.

The separation of different chemical agents in a single reservoir can be accomplished by a number of manners, one of the most simple is to place a rupturable barrier to block the mixing of first chemical agent and the second chemical agent. The rupturable barrier may be positioned to seal the chemical agent reservoirs. The rupturable barrier may be fabricated from any form of rupturable material, for example that will not substantially interfere with the flow of the chemical agents when ruptured. The rupturable barrier may be a frangible glass annular disk. Frangible glass has a highly stressed surface and disintegrates into fine particles when pierced. Such a piercing action can be delivered by a franging pin assembly comprising a franging pin. During use of the device, the franging pin is driven against the rupturable barrier. Typically, the franging pin is driven by an electrically initiated spring plunger. The franging pin assembly could also be mechanically initiated. The franging pin assembly can comprise small, electrically activated squib, or any number of mechanisms known to those of skill in the art, for example, a mechanically released spring plunger.

In yet other embodiments of the invention, the first portion further comprises a second reservoir. In certain aspects, the second reservoir and the first reservoir each comprise the first chemical agent. In other aspects, the second reservoir comprises a second chemical agent distinct from the first chemical agent.

In certain aspects, the first portion and the second portion are discrete units or components. In other aspects, the first portion and the second portion are comprised within a single unit. In certain aspects, the first and second portions, as well as other components of the system, are provided as snap together components. In certain aspects of the invention, the second portion will contain the explosive and the first portion contains the agent (pre-filled). This requirement allows separate shipping and handling and storage of the units. In certain aspects of the present invention, multiple apparati or units are inter-connected to provide a wider region of coverage. Connection can be unit-to-unit, or in alternate embodiments can rely on an explosive coupler such as detonation cord.

A charge holding device that could be offset from the mine and had an adjustable orientation capability for the penetrating jet would be desirable as it is often hazardous to work or place a charge directly over a mine due to sensitive triggering devices such as pressure plates and trip wires. Thus, in certain embodiments of the present invention, the apparatus for neutralizing an explosive device further comprises an orienting or positioning assembly to operably orient or position the apparatus in relation to the explosive device. In certain aspects, the positioning assembly is a stand or base standoff attached to the first portion. The arrangements for the base standoff contemplated for use include, but are not limited to: two or more legs, each leg extending substantially the length of one edge of the apparatus, the legs extending essentially perpendicular to the base of the apparatus; four legs proximal to the four comers of the base of the apparatus, the legs extending essentially perpendicular to the base of the apparatus; three legs, two legs proximal to two adjacent comers and the third leg proximal to the midpoint of the edge opposite the other two legs, the legs extending out at an angle away from the apparatus; and four legs proximal to the four comers of the base of the apparatus, the legs extending out at an angle away from the apparatus. In other embodiments, the positioning assembly comprises a stake and cross-member attached to the second portion. In yet other aspects, the positioning assembly comprises a cantilevered arm. Also included in the present invention is a probe that snaps in place and elements for use with a means of strapping the apparatus to objects such as trees.

In certain aspects of the present invention, a standoff, or separation, between the apparatus and the explosive device or overburden is preferred. Standoff distances from between about 0.5 inches and about 12 inches to 24 inches are contemplated, as well as intermediate standoff distances, such as about 1 inch, about 2 inches, about 2.5 inches, about 3 inches, about 4 inches, about 5 inches, about 6 inches, about 7 inches, about 8 inches, about 9 inches, about 10 inches, about 11 inches, about 15 inches, about 18 inches, about 20 inches or about 22 inches or so.

The present invention also provides a mine-destroying system, comprising a first portion comprising a first reservoir, a first chemical agent for destroying the mine disposed within the first reservoir, a second portion operably connected to the first portion, the second portion comprising an explosive assembly, and an orienting or positioning assembly or mechanism connected to the first portion or the second portion, to operably orient or position the first portion and the second portion in relation to a mine. In certain embodiments, the orienting or positioning assembly is a stake and a cross-member. In other aspects, the positioning assembly is a base standoff.

The invention further provides a method for neutralizing, clearing, or destroying an explosive device, comprising positioning at least a first apparatus for neutralizing, clearing or destroying an explosive device proximal to the explosive device, the apparatus comprising a first portion comprising a first reservoir, a first chemical agent for neutralizing the explosive device disposed within the first reservoir, a second portion operably connected to the first portion, the second portion comprising an explosive assembly, and detonating the explosive charge, thereby producing an opening in the explosive device and an opening in the first reservoir, thereby releasing the first chemical agent from the first reservoir, the first chemical agent entering the opening in the explosive device and neutralizing the explosive device. In certain applications a plurality of apparati for neutralizing, clearing or destroying an explosive device are positioned proximal to the explosive device.

In certain aspects of the invention, the positioning of the apparatus comprises hand placement of the apparatus. In other aspects, the positioning of the apparatus comprises automated placement of the apparatus. In certain preferred aspects, the apparatus is positioned by a robot.

Mobile robots, or Unmanned Ground Vehicles (UGVs), have been used in hazardous duty operations for many years to keep the operator at a safe distance. UGVs can be wheeled, tracked, or legged and they are typically powered electrically by batteries or electrical power from a tethered cable. These robots can be operated via tele-remote link or autonomous means. Tele-remote links often used include hard wire electrical cable, fiber optic cable, or RF telemetry type communications from an operator base station to the robot. They are often equipped with television camera which are viewed by the operator from a remote station to enhance operability. Many UGVs are equipped with manipulator type arms and grippers to enhance mission capabilities. UGVs can be designed to operate on the smooth concrete floors of nuclear power plants or to traverse the uneven terrain of minefields. Those of skill will be able to adapt and manufacture a suitable robot for the instant invention. The robot typically has at least one manipulator arm.

In particular embodiments, the explosive device is a mine. In these aspects, the mine can either be exposed, partially exposed or unexposed. In yet other embodiments, the explosive device is at least one piece of ordnance, including, but not limited to, a bomb, missile, bullet, mortar or shell.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

FIG. 6A. The explosive charge forms a jet penetrator. FIG. 6B. The jet penetrates through the overburden and toward the explosive device. FIG. 6C. The jet has opened the casing of the explosive device, and the remaining detonation products push reactive material out the end of the reservoir and through the opening formed by the jet penetrator. FIG. 6D. The follow-through material is either thermally ignited by the hot detonation products from the explosive charge or rapidly reacts exothermically with the explosive contents in the explosive device causing a sustained decomposition of the explosive fill of the explosive device. Decomposition gases of the explosive device are vented through the opening cut by the jet penetrator, thereby preventing violent casing rupture.

DESCRIPTION OF ILLUSTRATIVE EMBODIMENTS

In a most general aspect, the present invention comprises an apparatus for neutralizing an explosive device comprising an explosive charge that penetrates and opens the casing of the explosive device and forces reactive material out of a reservoir and into the explosive device. Presently preferred embodiments are shown in FIGS. 1 through 5, and a schematic representation of the operation of a preferred embodiment is shown in FIG. 6. This apparatus neutralizes the explosive device without initiating an explosive reaction, which minimizes or eliminates the destructive effects caused by traditional methods of explosive device clearance. The present apparatus also finds utility in demining operations where there exists fragile infrastructure.

Figure 1:
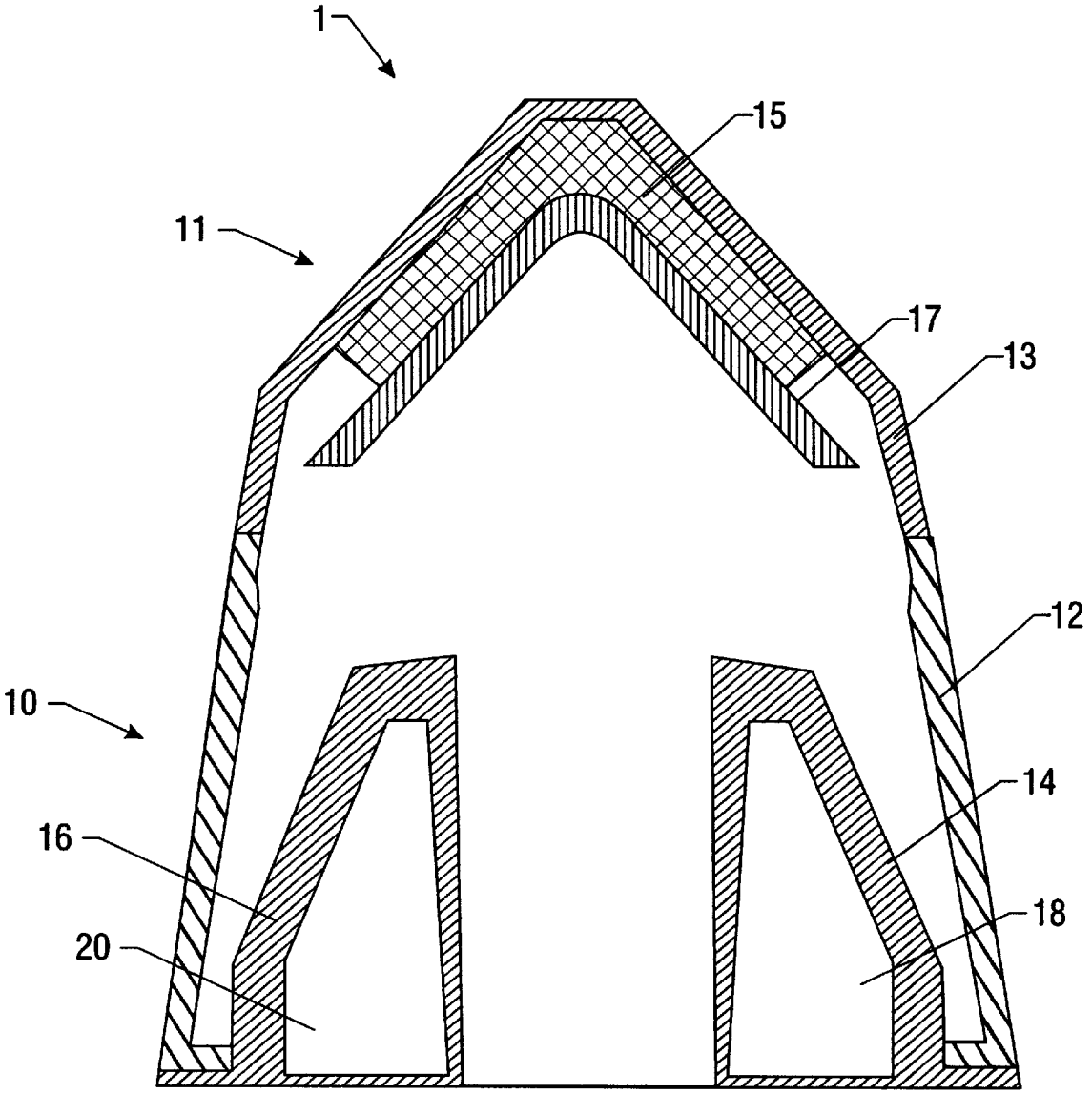
FIG. 1. A cross section of an exemplary embodiment of an apparatus for neutralizing an explosive device having a linear configuration and symmetry along section line A—A.

FIG. 1 shows a cross section of an exemplary embodiment of an apparatus for neutralizing an explosive device having a linear configuration and symmetry along section line A—A. In this embodiment, apparatus 1 comprises first portion 10 and second portion 11. First portion 10 comprises case 12, first reservoir 14 and second reservoir 16. First reservoir 14 comprises a first chemical agent 18, and second reservoir 16 comprises second chemical agent 20. Second portion 11 comprises housing 13, explosive fill 15 and liner 17.

Figure 2:
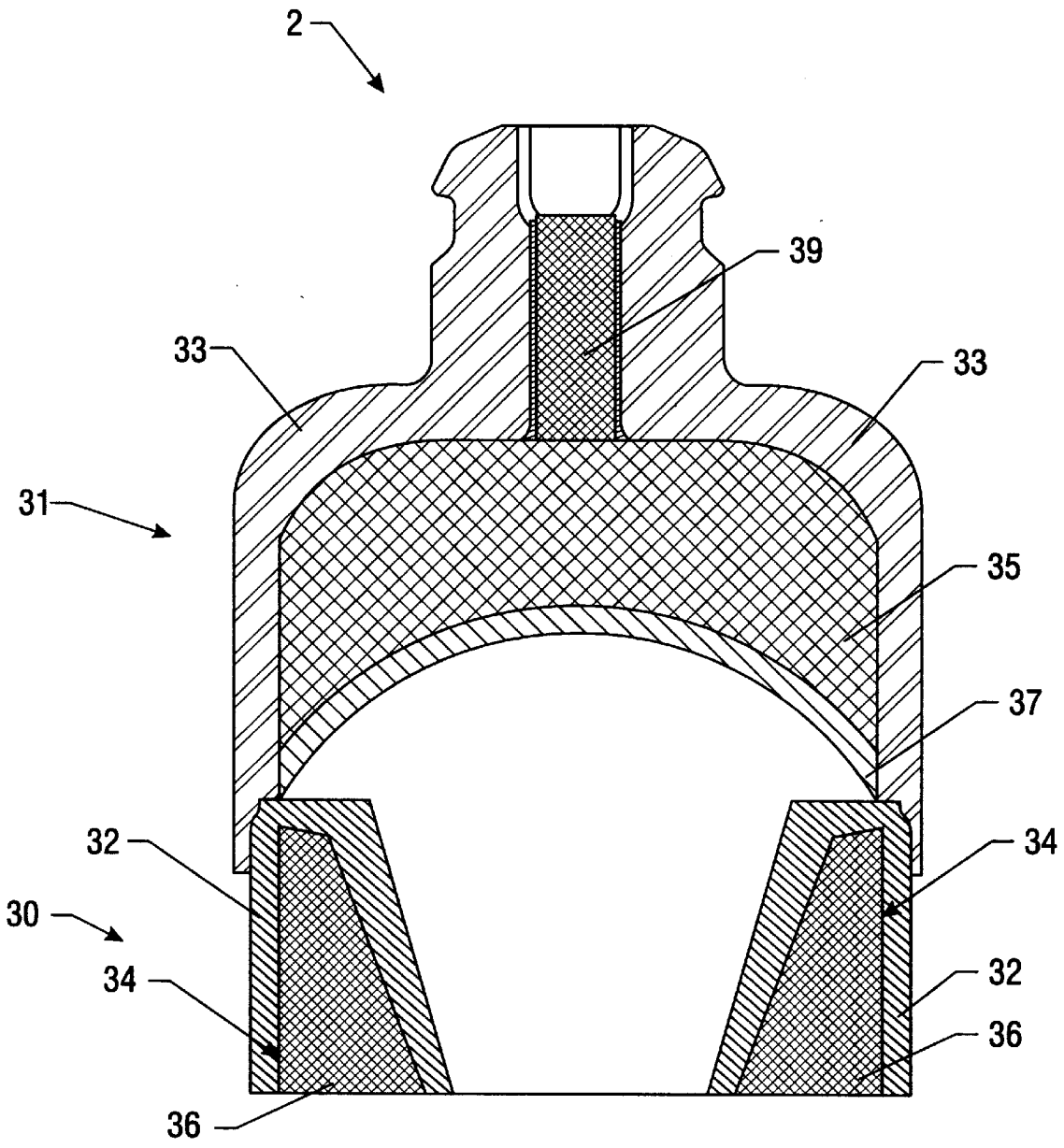
FIG. 2. A cross section of an exemplary embodiment of an apparatus for neutralizing an explosive device having a cylindrical configuration and axisymmetry along section line A—A.

FIG. 2 shows a cross section of an exemplary embodiment of an apparatus for neutralizing an explosive device having a cylindrical configuration and radial symmetry (axisymmetry) along section line A—A. In this embodiment, apparatus 2 comprises first portion 30 and second portion 31. First portion 30 comprises case 32 which defines first reservoir 34. First reservoir 34 comprises first chemical agent 36. Second portion 31 comprises housing 33, explosive fill 35, liner 37 and detonator 39.

Figure 3:
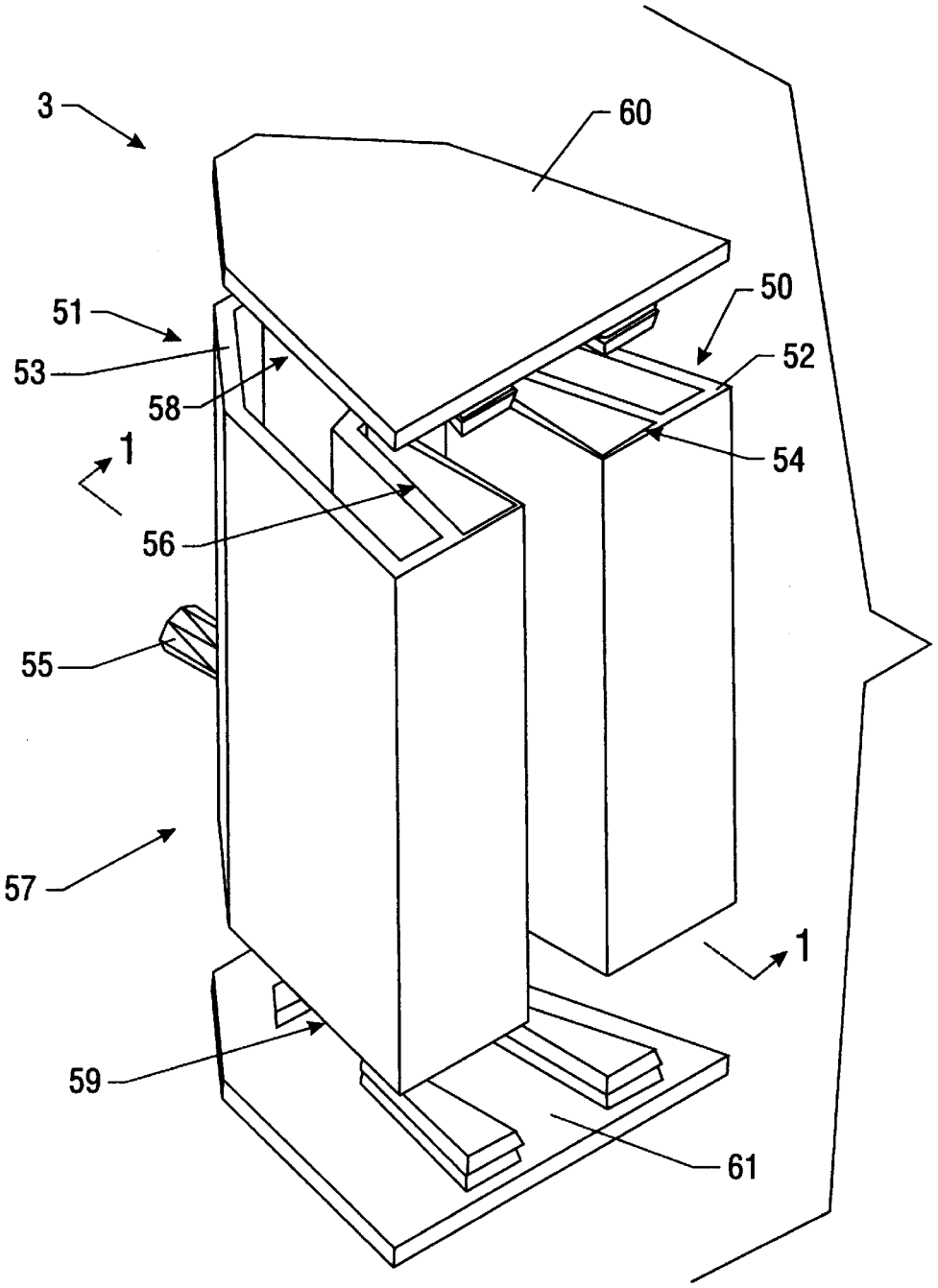
FIG. 3. A three-dimensional view of an exemplary embodiment of an apparatus for neutralizing an explosive device having a linear configuration, further comprising an exemplary embodiment of a first endplate and a second endplate.

FIG. 3 shows a three-dimensional view of an exemplary embodiment of an apparatus for neutralizing an explosive device having a linear configuration, further comprising an exemplary embodiment of a first endplate and a second endplate. In this embodiment, apparatus 3 comprises first portion 50 and second portion 51. First portion 50 comprises case 52 which defines first reservoir 54 and second reservoir 56. Second portion 51 comprises housing 53 and connector 55 for a detonator. In this embodiment, first portion 50 and second portion 51 form single unit 57 having first end 58 and second end 59. First endplate 60 attaches to first end 58 and second endplate 61 attaches to second end 59 to seal first reservoir 52 and second reservoir 54.

Figure 4:
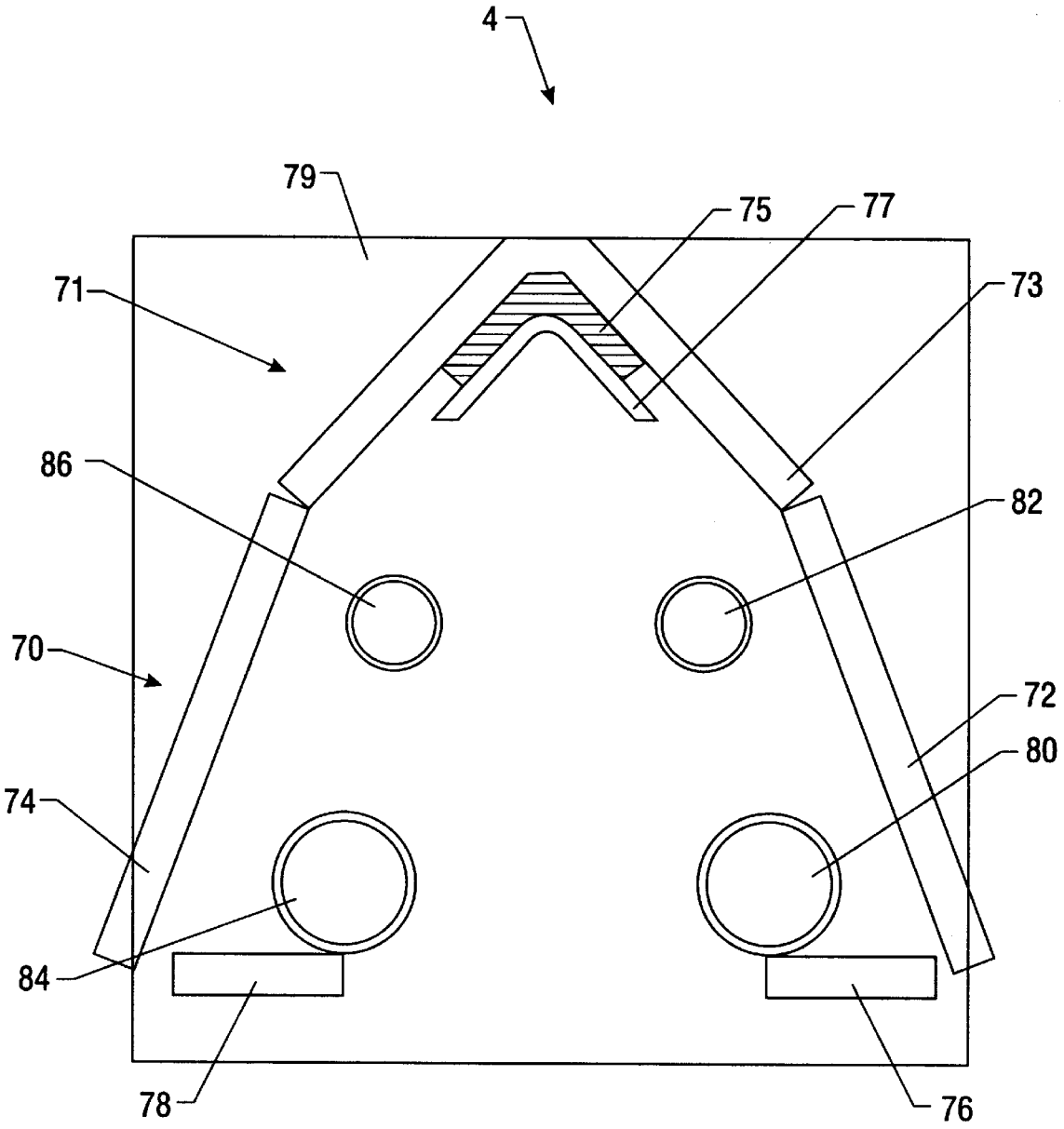
FIG. 4. A cross section of an exemplary embodiment of an apparatus for neutralizing an explosive device having a linear configuration and symmetry along section line A—A, comprising an alternate embodiment of chemical agent reservoirs.

FIG. 4 shows a cross section of an exemplary embodiment of an apparatus for neutralizing an explosive device having a linear configuration and symmetry along section line A—A, comprising an alternate embodiment of chemical agent reservoirs. In this embodiment, apparatus 4 comprises first portion 70 and second portion 71. First portion 70 comprises first sidewall 72, second sidewall 74, first base 76, second base 78, first reservoir 80, second reservoir 82, third reservoir 84 and fourth reservoir 86. Second portion 71 comprises housing 73, explosive fill 75 and liner 77. Endplate 79 attaches to first portion 70 and second portion 71.

Figure 5:
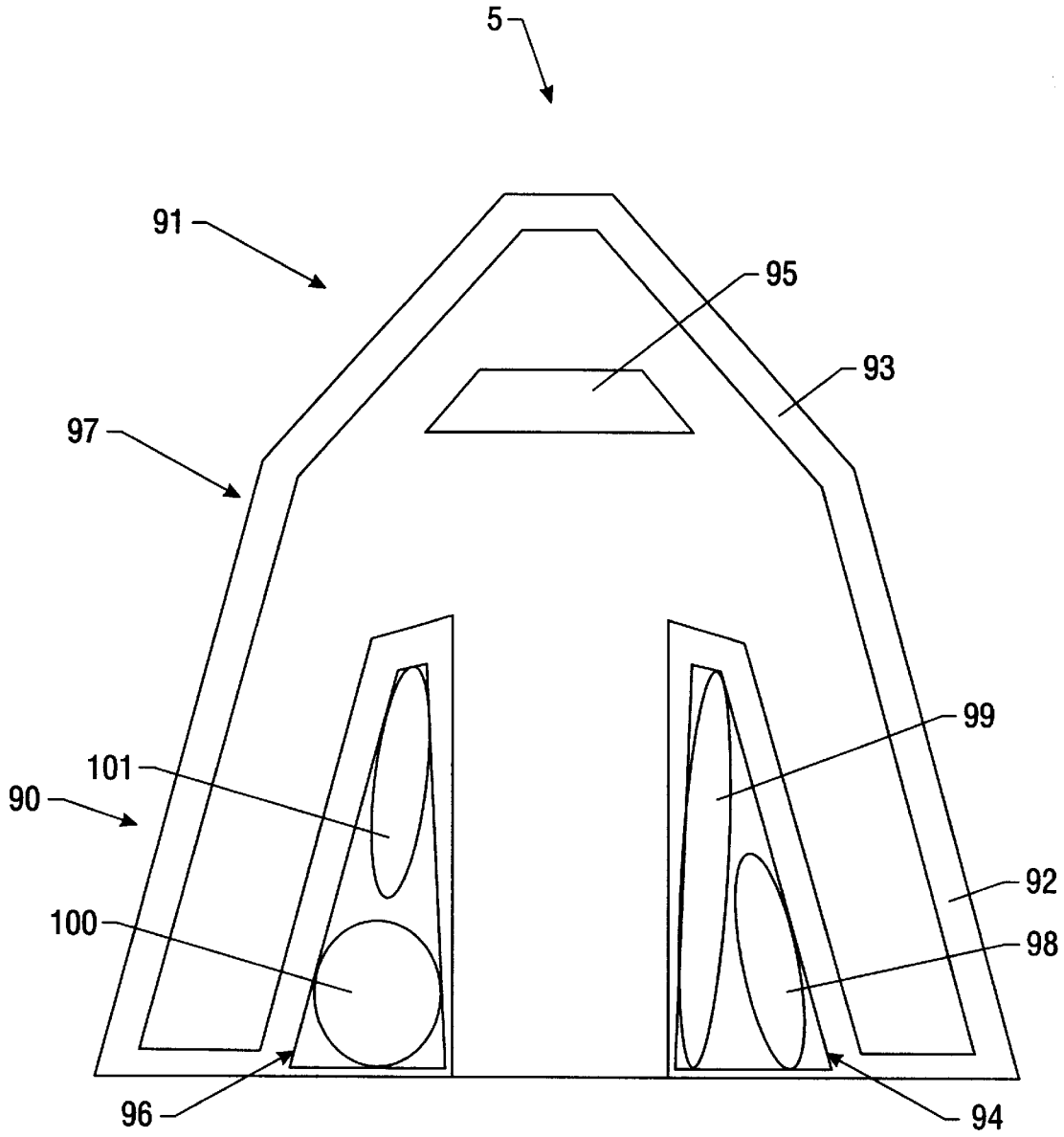
FIG. 5. A cross section of an exemplary embodiment of an apparatus for neutralizing an explosive device having a linear configuration, further comprising an exemplary embodiment of multiple modules comprised within the reservoirs.

FIG. 5 shows a cross section of an exemplary embodiment of an apparatus for neutralizing an explosive device having a linear configuration, further comprising an exemplary embodiment of multiple modules comprised within the reservoirs. In this embodiment, apparatus 5 comprises first portion 90 and second portion 91. First portion 90 comprises case 92 which defines first reservoir 94 and second reservoir 96. First reservoir 94 comprises first module 98 and second module 99, and second reservoir 96 comprises third module 100 and fourth module 101. Second portion 91 comprises housing 93 and explosive assembly 95. In this embodiment, first portion 90 and second portion 91 form single unit 97.

Figures 6A, 6B, 6C, 6D:
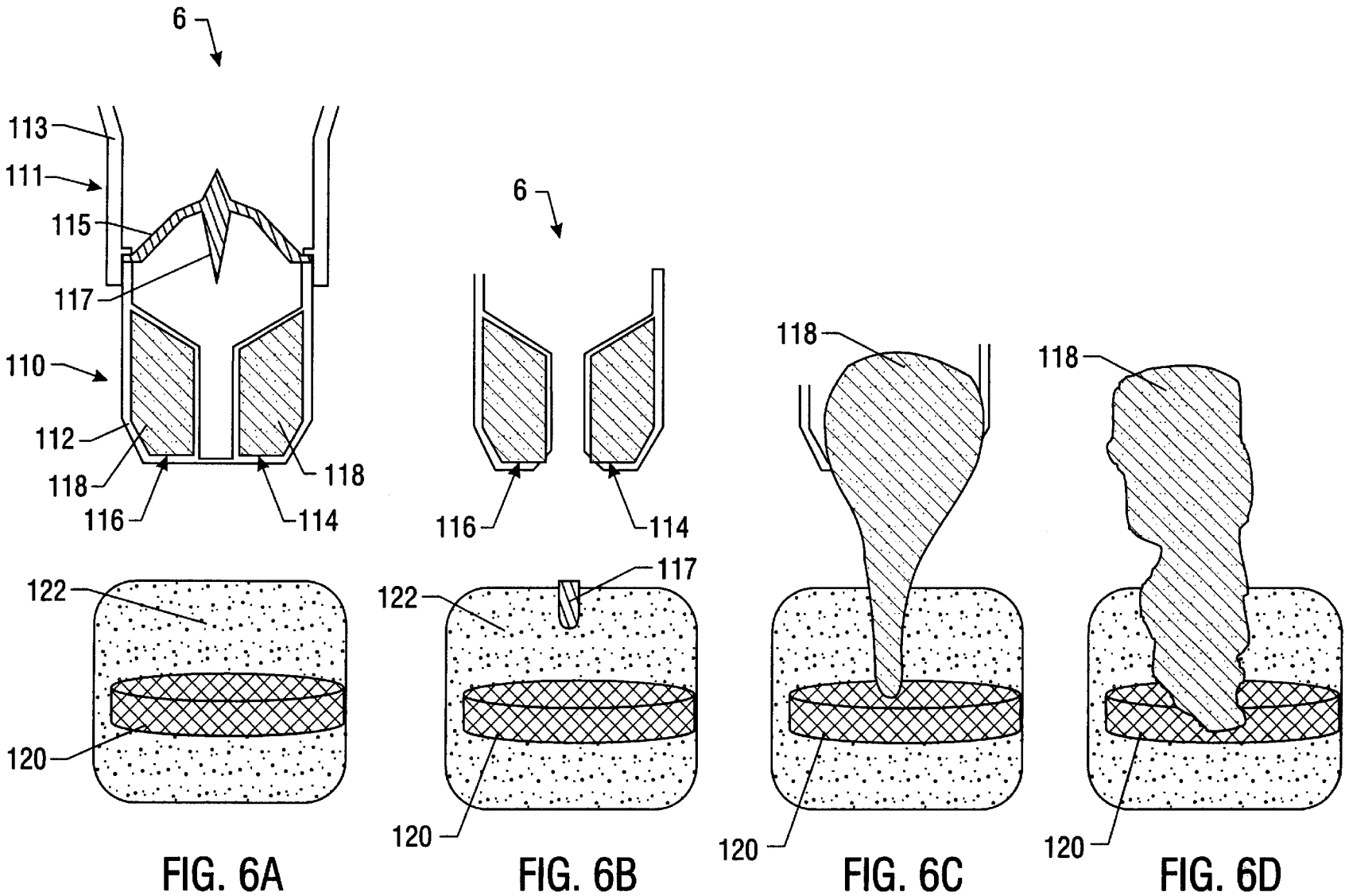
FIG. 6A, FIG. 6B, FIG. 6C and FIG. 6D. Schematic representation of the operation of an exemplary embodiment of an apparatus for neutralizing an explosive device.

FIG. 6A, FIG. 6B, FIG. 6C and FIG. 6D show a schematic representation of the operation of an exemplary embodiment of an apparatus for neutralizing an explosive device. FIG. 6A shows apparatus 6 after the explosive charge has formed jet penetrator 117. Shown in apparatus 6 is first portion 110 comprising case 112 defining first reservoir 114 and second reservoir 116. First reservoir 114 and second reservoir 116 comprise first chemical agent 118. Also shown is the remainder of second portion 111 comprising housing 113 and liner 115, which has formed jet penetrator 117. Also shown in FIG. 6A is explosive device 120 and overburden 122. FIG. 6B shows apparatus 6 after jet penetrator 117 has opened first reservoir 114 and second reservoir 116 and penetrated through overburden 122 and toward explosive device 120. FIG. 6C shows the remaining detonation products pushing first chemical agent 118 out the end of first reservoir 114 and second reservoir 116 and through the opening in explosive device 120 formed by the jet penetrator. FIG. 6D shows first chemical agent 118 continuing to push into the opening in explosive device 120. The follow-through first chemical agent 118 is either thermally ignited by the hot detonation products from the explosive charge or rapidly reacts exothermically with the explosive contents in explosive device 120 causing a sustained decomposition of the explosive fill of explosive device 120. Decomposition gases of explosive device 120 are vented through the opening cut by the jet penetrator, thereby preventing violent casing rupture.

Figure 7:
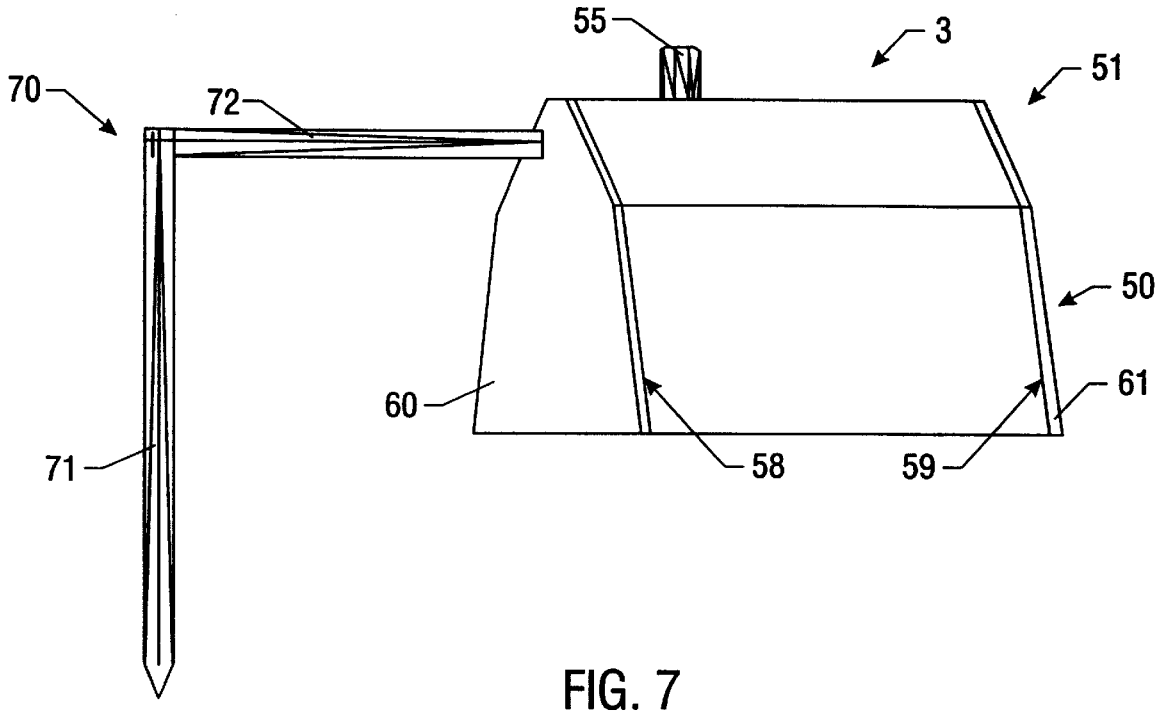
FIG. 7. A schematic view of an exemplary embodiment of an apparatus for neutralizing an explosive device as shown in FIG. 3, further comprising a positioning assembly comprising a stake and a cross-member.

FIG. 7 shows a schematic view of an exemplary embodiment of an apparatus for neutralizing an explosive device as shown in FIG. 3, further comprising a positioning assembly comprising a stake and a cross-member. Apparatus 3 comprises first portion 50, second portion 51 comprising connector 55 for a detonator, first endplate 60 attached to first end 58 and second endplate 61 attached to second end 59. Also shown is positioning assembly 70 comprising stake 71 and cross-member 72.

Figure 8:
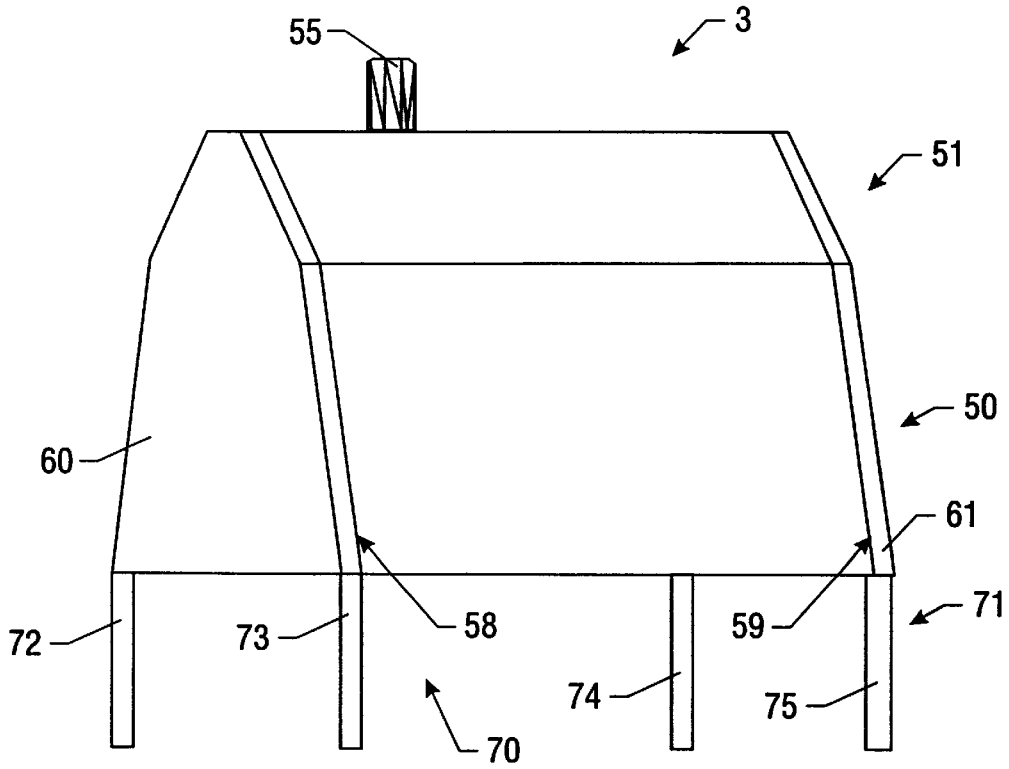
FIG. 8. A schematic view of an exemplary embodiment of an apparatus for neutralizing an explosive device as shown in FIG. 3, further comprising a positioning assembly comprising a base standoff comprising four legs.

FIG. 8 shows a schematic view of an exemplary embodiment of an apparatus for neutralizing an explosive device as shown in FIG. 3, further comprising a positioning assembly comprising a base standoff comprising four legs. Apparatus 3 comprises first portion 50, second portion 51 comprising connector 55 for a detonator, first endplate 60 attached to first end 58 and second endplate 61 attached to second end 59. Also shown is positioning assembly 70 comprising base standoff 71 comprising first leg 72, second leg 73, third leg 74 and fourth leg 75.

EXAMPLE 1

Linear Cutting Charge vs. Mine

This study was conducted to determine if a linear cutting charge (Comp A3 pressed explosive billet) will detonate a TNT-filled mine stimulant. An apparatus essentially as shown in FIG. 4, except that no reservoirs or bases were present, was placed in direct contact with a mine stimulant, thus directing most of the energy directly into the mine. As there were no agent reservoirs in this setup, more blast entered the mine, eliminating any question as to which (the line charge or agent) caused the observed reaction.

The mine reaction was classified as a Type III, (based on MIL-STD 2105-B, see Table 1 herein below). The mine case was recovered in one piece and most of the explosive was consumed. The reaction was not a high order detonation, it was a low order or deflagration. The case was not fragmented and there was an absence of any ground crater. Thus, a linear cutting charge in its most potent configuration does not cause a high order reaction into TNT. The device placed at any greater standoff imparts less energy into the mine due to the disperse nature of the jet (see following Examples). Accordingly mine reactions of Type III or less occur with the introduction of standoff or overburden.

TABLE 1

REACTION TYPES EXTRACTED FROM MIL-STD-2105B

| Reaction Type | Description |
|---|---|
| Type I | (Detonation Reaction). The most violent type of explosive event. A supersonic decomposition reaction propagates through the energetic material to produce an intense shock in the surrounding medium, air or water for example, and very rapid plastic deformation of metallic cases, followed by extensive fragmentation. All energetic material will be consumed. The effects will include large ground craters for munitions on or close to the ground, holing/plastic flow damage/fragmentation of adjacent metal plates, and blast overpressure damage to nearby structures. |
| Type II | (Partial Detonation Reaction). The second most violent type of explosive event. Some, but not all of the energetic material reacts as in a detonation. An intense shock is formed; some of the case is broken into small fragments; a ground crater can be produced, adjacent metal plates can be damaged as in a detonation, and there will be blast overpressure damage to nearby structures. A partial detonation can also produce large case fragments as in a violent pressure rupture (brittle fracture). The amount of damage, relative to a full detonation, depends on the portion of material that detonates. |
| Type III | (Explosion Reaction). The third most violent type of explosive event. Ignition and rapid burning of the confined energetic material builds up high local pressures leading to violent pressure rupturing of the confining structure. Metal cases are fragmented (brittle fracture) into large pieces that are often thrown long distances. Unreacted and/or burning energetic |

TABLE 1-continued

REACTION TYPES EXTRACTED FROM MIL-STD-2105B

| Reaction Type | Description |
|---|---|
| | material is also thrown about. Fire and smoke hazards will exist. Air shocks are produced that can cause damage to nearby structures. The blast and high velocity fragments can cause minor ground craters and damage (breakup, tearing, gouging) to adjacent metal plates. Blast pressures are lower than for a detonation. |
| Type IV | (Deflagration Reaction). The fourth most violent type of explosive event. Ignition and burning of the confined energetic materials leads to nonviolent pressure release as a result of a low strength case or venting through case closures (loading port/fuze wells, etc.). The case might rupture but does not fragment; closure covers might be expelled, and unburned or burning energetic material might be thrown about and spread the fire. Propulsion might launch an unsecured test item, causing an additional hazard. No blast or significant fragmentation damage to the surrounding; only heat and smoke damage from the burning energetic material. |
| Type V | (Burning Reaction). The least violent type of explosive event. The energetic material ignites and burns, non-propulsively. The case may open, melt or weaken sufficiently to rupture nonviolently, allowing mild release of combustion gasses. Debris stays mainly within the area of the fire. This debris is not expected to cause fatal wounds to personnel or be a hazardous fragment beyond 15 m (49 ft). |

In a most general sense, the preferred mine reactions obtained with the apparati of the present invention are reaction types III, IV and V.

EXAMPLE 2

Linear Cutting Charge vs. Mine With Standoff

This study was conducted to determine if a linear cutting charge will detonate a TNT-filled mine stimulant when a standoff is added between the apparatus comprising the charge and the mine stimulant. This is similar to the study in Example 1 above, however, a ¼" steel plate and 1 " thick foam piece separated the mine and the neutralization apparatus (the apparatus was essentially the same as described in Example 1 above, with no reservoirs or bases present). The additional material was added to determine if the jet energy was reduced (expended in cutting the steel plate), thus yielding a less energetic mine reaction.

The mine reaction was classified as a Type IV (see Table 1 above). The mine case was recovered in one piece, and little explosive was consumed. The explosive fill lightly burned for a few seconds and then self-extinguished. This study showed that adding a standoff decreased the mine reaction.

EXAMPLE 3

Linear Cutting Charge vs. Mine With Standoff and Overburden

This study was conducted to determine if a linear cutting charge will detonate a TNT-filled mine stimulant when a standoff is added between the apparatus comprising the charge and the mine stimulant, and an overburden is placed over the mine stimulant. This is similar to the study in Example 1 above, except that a ¾ inch overburden of sand was placed over the mine stimulant, and the apparatus (apparatus as described in Example 2 above) was placed 3 inches above the surface of the overburden.

This study demonstrated the ideal function of the linear cutting charge. The mine case was opened and the explosive was cut. This exposed a large surface area for reaction with the chemical agent. At the same time, the explosive was not pulverized or thrown around which indicated the jet energy deposited into the explosive was rather low.

EXAMPLE 4

DETA Charge vs. Mine

This study was conducted to determine the approximate amount of DETA required to cause a bum reaction and neutralize the TNT explosive fill of a mine stimulant. A tube (½ inch inside diameter) with DETA fill (approximately 9 ml) and an RP-2 detonator was placed in contact with the explosive fill of a mine stimulant.

The RP-2 burst a hole in one side of the agent tube. The pressure drove the end plugs out of the tube as the tube was recovered afterwards without the end plugs. It took about two seconds for the agent to drain out of the tube and start a burning reaction. The explosive burned with a visible flame for about eight and one half minutes. The mine stimulant continued to smoke for an additional eight minutes before becoming dormant. All of the explosive fill was consumed, indicating that a small amount of DETA was required to neutralize the TNT fill.

EXAMPLE 5

Complete Neutralization Apparatus vs. Mine

This study was conducted to determine if an embodiment of the present explosive device neutralization apparatus could neutralize a mine stimulant without detonating the TNT explosive fill. The apparatus used was the apparatus shown in FIG. 4, with approximately 62 ml of DETA total comprised within the four reservoirs. The apparatus was placed over the mine stimulant at a 5.5" standoff with no overburden. The Comp A3 pressed explosive billet was replaced with a 0.125-inch thick detasheet. This represents about half (52%) of the explosive used in the studies shown in Examples 1–4 above. Additional modifications were made to the side plate in order to reduce any 'end effect' of the hardware performance. The endplate was cut out in the region of the explosive and was scored across the entire width above the region where the agent reservoirs are attached.

The linear charge was sufficiently degraded by the air standoff so that the reaction was significantly less than that observed in the Examples above. It was evident that a very large, but brief fireball developed prior to the ignition of the mine. This may have been the reaction of the agent with some of the TNT that was ejected from the mine. The mine burned for about 8 and one half minutes and then smoked for another 20 seconds. All of the explosive fill of the mine stimulant was consumed.

All of the methods and/or devices disclosed and claimed herein can be made and executed without undue experimentation in light of the present disclosure. While the compositions and methods of this invention have been described in terms of preferred embodiments, it will be apparent to those of skill in the art that variations may be applied to the methods and/or apparati, and in the steps or in the sequence of steps of the methods described herein, without departing from the concept, spirit and scope of the invention. More specifically, it will be apparent that certain agents which are both chemically and physiologically related may be substituted for the agents described herein while the same or similar results would be achieved. All such similar substitutes and modifications apparent to those skilled in the art are deemed to be within the spirit, scope and concept of the invention as defined by the appended claims.

What is claimed is:

1. An apparatus for neutralizing an explosive device, comprising:

a) a first portion comprising a first reservoir;

b) a first chemical agent for neutralizing said explosive device, said first chemical agent disposed within said first reservoir; and c) a second portion operably connected to said first portion, said second portion comprising an explosive assembly.

2. The apparatus of claim 1, wherein said explosive assembly comprises a liner and an explosive charge.

3. The apparatus of claim 2, wherein said liner is fabricated from plastic or low density metal.

4. The apparatus of claim 2, wherein said explosive charge is a linear charge or a cylindrical shaped charge.

5. The apparatus of claim 1, wherein said apparatus further comprises a front faceplate attached to said first portion and said second portion.

6. The apparatus of claim 1, wherein said apparatus further comprises a front faceplate and a back faceplate attached to said first portion and said second portion.

7. The apparatus of claim 1, wherein said first portion is fabricated from plastic.

8. The apparatus of claim 1, wherein said second portion further comprises a housing.

9. The apparatus of claim 8, wherein said housing is fabricated from plastic.

10. The apparatus of claim 1, further comprising a detonator operably connected to said explosive assembly.

11. The apparatus of claim 1, wherein said first reservoir is adapted to rupture or open during use of the apparatus, thereby releasing the first chemical agent.

12. The apparatus of claim 1, wherein said first reservoir is formed within said first portion.

13. The apparatus of claim 1, wherein said first reservoir is attached to said first portion.

14. The apparatus of claim 1, wherein said first reservoir is fabricated from plastic.

15. The apparatus of claim 14, wherein said first reservoir is fabricated from polytetrafluoroethylene or vinylidene fluoride-hexafluoropropylene.

16. The apparatus of claim 1, wherein said first chemical agent is diethylene triamine.

17. The apparatus of claim 1, wherein said first reservoir further comprises a second chemical agent to neutralize said explosive device.

18. The apparatus of claim 17, wherein said first reservoir further comprises a barrier that separates said first chemical agent from said second chemical agent prior to use.

19. The apparatus of claim 18, wherein said barrier is adapted to rupture or open during use of the apparatus, thereby allowing the first chemical agent and the second chemical agent to mix and exit the reservoir.

20. The apparatus of claim 1, wherein said first portion further comprises a second reservoir.

21. The apparatus of claim 20, wherein said second reservoir also comprises said first chemical agent.

22. The apparatus of claim 20, wherein said second reservoir comprises a second chemical agent distinct from said first chemical agent.

23. The apparatus of claim 1, wherein said first portion and said second portion are discrete units.

24. The apparatus of claim 1, wherein said first portion and said second portion are comprised within a single unit.

25. The apparatus of claim 1, further comprising a positioning assembly to operably position said apparatus in relation to said explosive device.

26. The apparatus of claim 25, wherein said positioning assembly comprises a base standoff operably connected to said first portion.

27. The apparatus of claim 25, wherein said positioning assembly comprises a stake and a cross-member, said cross-member attached to said stake and operably connected to said second portion.

28. A mine-destroying system, comprising:

a) a first portion comprising a first reservoir;

b) a first chemical agent for destroying the mine disposed within said first reservoir;

c) a second portion connected to said first portion, said second portion comprising an explosive assembly; and d) a positioning assembly connected to said first portion or said second portion, to operably position said first portion and said second portion in relation to a mine.

29. A method for neutralizing an explosive device, comprising:

a) positioning at least a first apparatus proximal to said explosive device, said apparatus comprising:

i) a first portion comprising a first reservoir;

ii) a first chemical agent for neutralizing said explosive device disposed within said first reservoir; and iii) a second portion connected to said first portion, said second portion comprising an explosive assembly; and b) detonating said explosive assembly, thereby producing an opening in said explosive device and an opening in said first reservoir, thereby releasing said first chemical agent from said first reservoir, said first chemical agent entering the opening in said explosive device and neutralizing said explosive device.

30. The method of claim 29, wherein said explosive device is a mine.

31. The method of claim 30, wherein said mine is exposed.

32. The method of claim 30, wherein said mine is partially exposed.

33. The method of claim 30, wherein said mine is unexposed.

34. The method of claim 29, wherein said explosive device is at least one piece of ordnance.

* * * * *